US008289348B2

(12) United States Patent
Higuchi

(10) Patent No.: US 8,289,348 B2
(45) Date of Patent: Oct. 16, 2012

(54) IMAGE SIGNAL PROCESSING DEVICE

(75) Inventor: Tomohisa Higuchi, Tokyo (JP)

(73) Assignee: Thine Electronics, Inc., Tokyo (JP)

( * ) Notice: Subject to any disclaimer, the term of this patent is extended or adjusted under 35 U.S.C. 154(b) by 331 days.

(21) Appl. No.: 12/673,699

(22) PCT Filed: Aug. 6, 2008

(86) PCT No.: PCT/JP2008/064124

§ 371 (c)(1),
(2), (4) Date: Apr. 15, 2010

(87) PCT Pub. No.: WO2009/025180

PCT Pub. Date: Feb. 26, 2009

(65) Prior Publication Data

US 2010/0245226 A1 Sep. 30, 2010

(30) Foreign Application Priority Data

Aug. 17, 2007 (JP) ..... 2007-212933

(51) Int. Cl.
*G09G 5/10* (2006.01)

(52) U.S. Cl. ..... 345/690; 345/87; 345/691; 345/99; 345/100; 345/204

(58) Field of Classification Search ..... 345/87, 345/690, 691, 99, 89, 100, 204; 348/694; 382/251

See application file for complete search history.

(56) References Cited

U.S. PATENT DOCUMENTS

| | | | | |
|---|---|---|---|---|
| 7,123,224 | B2 * | 10/2006 | Lee | 345/89 |
| 2001/0038372 | A1 * | 11/2001 | Lee | 345/89 |
| 2004/0189565 | A1 * | 9/2004 | Someya | 345/87 |

FOREIGN PATENT DOCUMENTS

| | | | |
|---|---|---|---|
| CN | 1625764 | A | 6/2005 |
| JP | 2001-265298 | A | 9/2001 |
| JP | 2002-082657 | A | 3/2002 |
| JP | 2004-004629 | A | 1/2004 |
| JP | 2004-004829 | A | 1/2004 |
| JP | 2004-078129 | A | 3/2004 |
| JP | 2004-109796 | A | 4/2004 |
| JP | 2005-352155 | A | 12/2005 |

OTHER PUBLICATIONS

Chinese Office Action issued Sep. 7, 2011 in Chinese Application No. 200880102996.X.

Notice of Allowance issued in Japanese Application No. 2007-212933 dated May 29, 2012.

* cited by examiner

*Primary Examiner* — Lun-Yi Lao
*Assistant Examiner* — Shaheda Abdin
(74) *Attorney, Agent, or Firm* — Sughrue Mion, PLLC

(57) ABSTRACT

An image signal processing device 1 comprises a delay part 10, a basic correction value output part 20, and a corrected image data output part 30. To the basic correction value output part 20, data $G_1[7:4]$ of high order 4 bits of image data $G_1[7:0]$ of a first frame to be output from the delay part 10 is input and data $G_2[7:4]$ of high order 4 bits of image data $G_2[7:0]$ of a second frame to be input to the delay part 10 is input, and the basic correction value output part 20 outputs basic correction values $D_1$ to $D_4$ corresponding to the data. To the corrected image data output part 30, $G_1[7:0]$, $G_2[7:0]$ and $D_1$ to $D_4$ are input, and the corrected image data output part 30 performs when "$G_1[7:4]=G_2[7:4]$" holds and performs different processing when "$G_1[7:4]\neq G_2[7:4]$" holds, and acquires corrected image data $G_2'[7:0]$ corresponding to data ($G_1[7:0]$, $G_2[7:0]$) by interpolation calculation.

2 Claims, 9 Drawing Sheets

IMAGE SIGNAL PROCESSING DEVICE

TECHNICAL FIELD

The present invention relates to an image signal processing device that outputs an image signal to a liquid crystal display device after processing image data of each frame of the image signal.

BACKGROUND ART

An image display device is roughly classified into an impulse type display device and a hold type display device. In a CRT (Cathode Ray Tube) mentioned of as an example of an impulse type display device, a screen is scanned by an electron gun and a display is produced only in pixels that electron beams have reached. In contrast to this, in a liquid crystal display device or an organic electroluminescence display device mentioned of as a hold type display device, a frame of an image signal is updated at a fixed period and when a display of an image of a certain first frame is specified, the display of the image of the first frame is held until a display of an image of a second frame that follows is specified. Compared to an impulse type display device, a hold type display device has various characteristics, such as that image distortion is unlikely to occur.

However, a liquid crystal display device has a problem that response is slow. That is, it takes time for an actual display value in a liquid crystal display device to reach a target display value after the target display value of an image of a certain frame is specified. There may be a case where the required time exceeds a period at which a frame is updated. Consequently, when a motion picture in which images changes rapidly is displayed on the screen of a liquid crystal display device, there may be a case where blur appears in the motion picture.

As a technique intended to solve such a problem, the overdrive technique is publicly known. According to the overdrive technique, when a certain pixel on the screen of a liquid crystal display device is focused on, if image data $G_2$ corresponding to a target display value in the next second frame is different from image data (luminance) $G_1$ corresponding to a target display value in a certain first frame, the image data $G_2$ is corrected and then, corrected image data $G_2'$ is given to the liquid crystal display device. At the time of the correction, when "$G_1<G_2$", $G_2$ is corrected so that "$G_2<G_2'$" and when "$G_1>G_2$", then $G_2$ is corrected so that "$G_2>G_2'$". By providing an image signal processing device that outputs an image signal to a liquid crystal display device after processing image data of each frame of the image signal as described above, it is made possible for the actual display value to reach the target display value quickly in the liquid crystal display device.

There have been made various proposals relating to the overdrive technique. In the invention disclosed in patent document 1, a lookup table, in which each value of the above-mentioned image data ($G_1$, $G_2$) and the corrected image data $G_2'$ are associated with each other and stored, is used and the corrected image data $G_2'$ corresponding to the image data ($G_1$, $G_2$) is output from the lookup table for each pixel. In this case, for example, when the image data is 8 bits and the display value is in the range of 0 to 255, the number of kinds of the data ($G_1$, $G_2$) to be input to the lookup table is 65,536 (=256×256), and therefore, it is necessary to use a memory of large capacity as the lookup table.

Patent documents 1, 2 disclose the invention that aims at reduction in the capacity of a memory used as the lookup table. In the invention disclosed in these documents, only the high order bits of the respective data $G_1$, $G_2$ are input to the lookup table, and the corrected image data $G_2'$ is acquired by interpolation calculation based on the data output from the lookup table.

Patent document 1: Japanese Unexamined Patent Publication (Kokai) No. 2005-352155

Patent document 2: Japanese Unexamined Patent Publication (Kokai) No. 2004-004829

DISCLOSURE OF THE INVENTION

However, with the overdrive technique in which the corrected image data $G_2'$ is acquired from the lookup table and by interpolation calculation as described above, if the corrected image data $G_2'$ acquired by interpolation calculation is given to a liquid crystal display device, there may be a case where the image quality of an image displayed on a screen of the liquid crystal display device is deteriorated due to a flicker etc.

The present invention has been developed in order to solve the above-mentioned problems and an object thereof is to provide an image signal processing device that employs the overdrive technique in which corrected image data is acquired by a lookup table and interpolation calculation and capable of suppressing image quality from deteriorating due to a flicker etc.

An image signal processing device according to the present invention is an image signal processing device that outputs an image signal to a liquid crystal display device after processing image data of each frame of the image signal, comprising (1) a delay part to which image data of each frame of an image signal is input, and which outputs the image data after delaying the image data by a period of time corresponding to one frame, (2) a basic correction value output part to which data $G_1[n-1:k]$ of high order (n−k) bits of image data $G_1[n-1:0]$ of n bits of a first frame to be output from the delay part and $G_2[n-1:k]$ of high order (n−k) bits of image data $G_2[n-1:0]$ of n bits of a second frame to be input to the delay part are input, and which outputs a basic correction value $D_1$ corresponding to data ($G_1[n-1:k]$, $G_2[n-1:k]$), a basic correction value $D_2$ corresponding to data ($G_1[n-1:k]$, $G_2[n-1:k]+1$), a basic correction value $D_3$ corresponding to data ($G_1[n-1:k]+1$, $G_2[n-1:k]$) and a basic correction value $D_4$ corresponding to data ($G_1[n-1:k]+1$, $G_2[n-1:k]+1$), and (3) a corrected image data output part to which the image data $G_1[n-1:0]$ of n bits of the first frame to be output from the delay part, the image data $G_2[n-1:0]$ of n bits of the second frame to be input to the delay part, and the basic correction values $D_1$ to $D_4$ output from the basic correction value output part are input, and which acquires corrected image data corresponding to data ($G_1[n:0]$, $G_2[n:0]$) by interpolation calculation and outputs the corrected image data that is acquired to the liquid crystal display device. Here, n is an integer equal to four or greater and k is an integer equal to two or greater and equal to (n−2) or less.

Further, in the image signal processing device according to the present invention, the corrected image data output part (a) acquires, when "$G_1[n-1:k]=G_2[n-1:k]$" holds for the high order (n−k) bits of the image data, corrected image data by interpolation calculation based on the basic correction values $D_1$, $D_2$ and $D_4$ if "$G_1[k-1:0]<G_2[k-1:0]$" holds for the low order k bits of the image data, or acquires corrected image data by interpolation calculation based on the basic correction values $D_1$, $D_3$ and $D_4$ if "$G_1[k-1:0]\geqq G_2[k-1:0]$" holds for the low order k bits of the image data, and (b) acquires corrected image data by bilinear interpolation calculation based on the basic correction values $D_1$ to $D_4$ when "$G_1[n-1:k]\neq G_2[n-1:k]$" holds for the high order (n−k) bits of the image data.

In the image signal processing device according to the present invention, the data $G_1[n-1:k]$ of high order (n−k) bits of the image data $G_1[n-1:0]$ of n bits of the first frame to be output from the delay part and the data $G_2[n-1:k]$ of high order (n−k) bits of the image data $G_2[n-1:0]$ of n bits of the second frame to be input to the delay part are input to the basic correction value output part. Then, from the basic correction value output part, the basic correction value $D_1$ corresponding to the data ($G_1[n-1:k]$, $G_2[n-1:k]$), the basic correction value $D_2$ corresponding to the data ($G_1[n-1:k]$, $G_2[n-1:k]+1$), the basic correction value $D_3$ corresponding to the data ($G_1[n-1:k]+1$, $G_2[n-1:k]$) and the basic correction value $D_4$ corresponding to the data ($G_1[n-1:k]+1$, $G_2[n-1:k]+1$) are output to the corrected image data output part.

To the corrected image data output part, the image data $G_1[n-1:0]$ of n bits of the first frame, the image data $G_2[n-1:0]$ of n bits of the second frame, and the basic correction values $D_1$ to D output from the basic correction value output part are input, and corrected image data corresponding to the data ($G_1[n:0]$, $G_2[n:0]$) is acquired by interpolation calculation, and the corrected image data that is acquired is output to the liquid crystal display device.

In particular, in the corrected image data output part, the processing performed when "$G_1[n-1:k]=G_2[n-1:k]$" holds for the high order (n−k) bits of the image data is different from the processing performed when "$G_1[n-1:k]\neq G_2[n-1:k]$" holds. Further, when the former "$G_1[n-1:k]=G_2[n-1:k]$" holds, in the corrected image data output part, the processing performed when "$G_1[k-1:0]<G_2[k-1:0]$" holds for the lower order k bits of the image data is different from the processing performed when "$G_1[k-1:0]\geqq G_2[k-1:0]$" holds. That is, in the corrected image data output part, when both "$G_1[n-1:k]=G_2[n-1:k]$" and "$G_1[k-1:0]<G_2[k-1:0]$" hold, corrected image data is acquired by interpolation calculation based on the basic correction value $D_1$, $D_2$ and $D_4$, and when "$G_1[n-1:k]=G_2[n-1:k]$" and "$G_1[k-1:0]\geqq G_2[k-1:0]$" both hold, corrected image data is acquired by interpolation calculation based on the basic correction value $D_1$, $D_3$ and $D_4$, and when "$G_1[n-1:k]\neq G_2[n-1:k]$" holds, corrected image data is acquired by bilinear interpolation calculation based on the basic correction value $D_1$ to $D_4$.

In the image signal processing device according to the present invention, when "$G_1[n-1:k]=G_2[n-1:k]$" holds for the high order (n−k) bits of the image data, it is preferable to take a value obtained by an expression "$D_3=D_1+D_4-D_2$" as the basic correction value $D_3$ when "$G_1[k-1:0]<G_2[k-1:0]$" holds for the low order k bits of the image data and to take a value obtained by an expression "$D_2=D_1+D_4-D_3$" as the basic correction value $D_2$ when "$G_1[k-1:0]\geqq G_2[k-1:0]$" holds for the low order k bits of the image data, and then to acquire corrected image data by bilinear interpolation calculation based on these basic correction values $D_1$ to $D_4$.

In this case, when both "$G_1[n-1:k]=G_2[n-1:k]$" and "$G_1[k-1:0]<G_2[k-1:0]$" hold, a value obtained by the expression "$D_3=D_1+D_4-D_2$" is taken as the basic correction value $D_3$ and when both "$G_1[n-1:k]=G_2[n-1:k]$" and "$G_1[k-1:0]\geqq G_2[k-1:0]$" hold, a value obtained by the expression "$D_2=D_1+D_4-D_3$" is taken as the basic correction value $D_2$. Then, after that, corrected image data is acquired by bilinear interpolation calculation based on the basic correction values $D_1$ to $D_4$ in all of the cases.

The above-mentioned processing may be performed for the entire image data of the frame, however, when only a partial region of an image displayed on the screen is a motion picture, the processing may be performed only for the image data corresponding to the partial region.

With the image signal processing device according to the present invention, it is possible to suppress image quality from deteriorating due to a flicker etc. by employing the overdrive technique to acquire corrected image data using a lookup table or by interpolation calculation.

DESCRIPTION OF THE REFERENCE SYMBOLS

Figure 1:
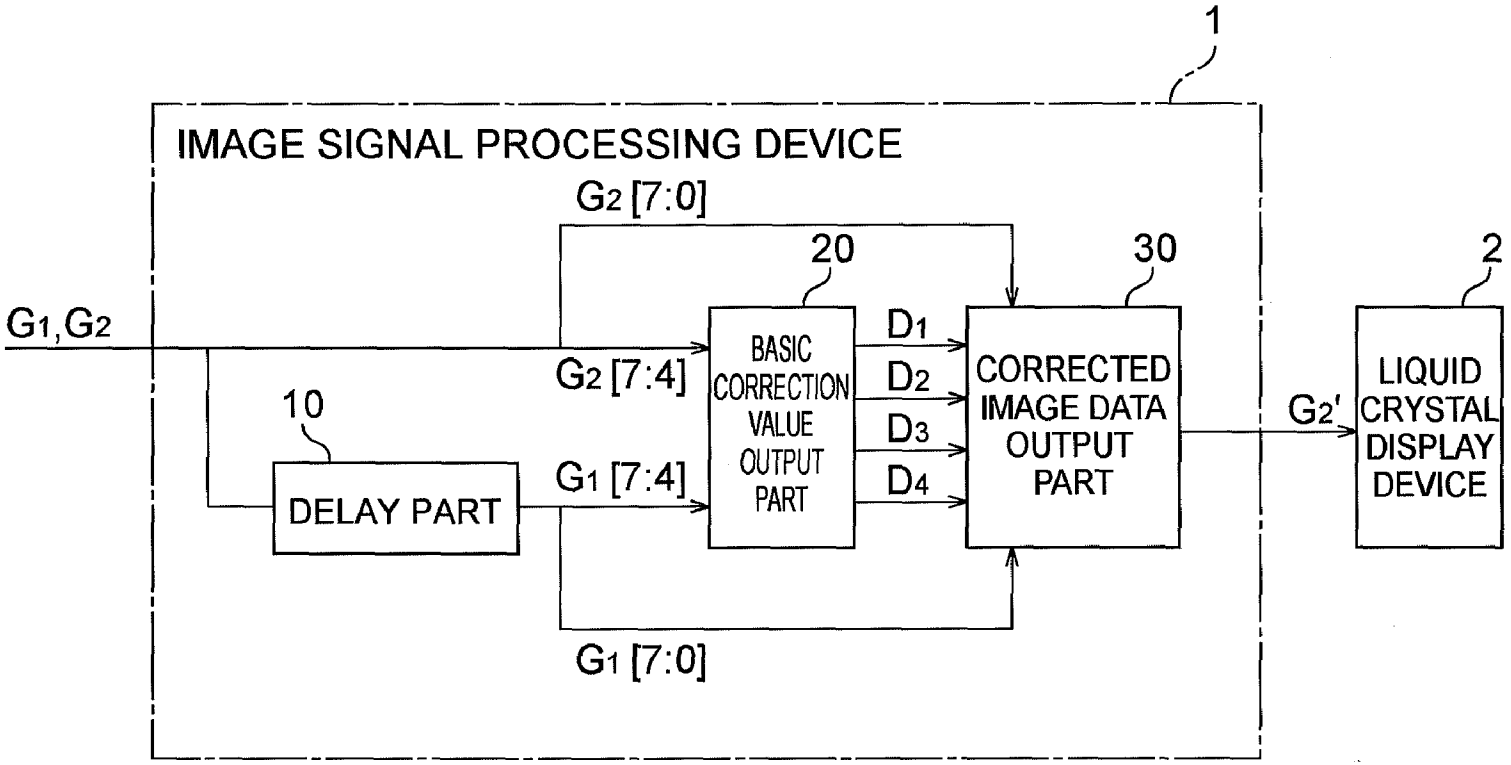
FIG. 1 is a diagram showing a configuration of an image signal processing device 1 according to the present embodiment.

1 image signal processing device
2 liquid crystal display device
10 delay part
20 basic correction value output part
30 corrected image data output part
31 basic correction value conversion part
32 interpolation calculation part

BEST MODES FOR CARRYING OUT THE INVENTION

Preferred embodiments to embody the present invention are described below in detail with reference to the accompanied drawings. In the description of the drawings, the same symbols are attached to the same components and duplicated description is omitted.

FIG. 1 is a diagram showing a configuration of an image signal processing device 1 according to the present embodiment. The image signal processing device 1 outputs an image signal to a liquid crystal display device 2 after processing image data of each frame of the image signal, and comprises a delay part 10, a basic correction value output part 20 and a corrected image data output part 30. Hereinafter, it is assumed that the image data (luminance) is 8-bit data. In the case of a color image, each image data of each color is assumed to be 8-bit data and the image data of one color of the color image is described below, however, the description applies also to the image data of the other colors.

To the delay part 10, image data of each frame of an image signal is input, and the delay part 10 outputs the image data to the basic correction value output part 20 after delaying the image data by a period of time corresponding to one frame, and is configured so as to include a frame memory.

To the basic correction value output part 20, data $G_1[7:4]$ of high order 4 bits of image data $G_1[7:0]$ of 8 bits of the first frame to be output from the delay part 10 is input and at the same time, $G_2[7:4]$ of high order 4 bits of the image data $G_2[7:0]$ of 8 bits of the second frame to be input to the delay part 10 is input. The second frame is a frame that follows the first frame. The image data $G_1[7:0]$ and $G_2[7:0]$ input simultaneously to the basic correction value output part 20 correspond to the common pixels on the screen of the liquid crystal display device 2.

Each of the data $G_1[7:4]$ and $G_2[7:4]$ is any one of values 0000 to 1111 in the binary number system and any one of integers 0 to 15 in the decimal number system. For example, in the binary number system, when $G_1[7:0]$ is in the range of 00000000 to 00001111, $G_1[7:4]$ is 0000 and when $G_1[7:0]$ is in the range of 11110000 to 11111111, $G_1[7:4]$ is 1111.

Then, the basic correction value output part 20 outputs the basic correction value $D_1$ corresponding to data ($G_1[7:4]$, $G_2[7:4]$), the basic correction value $D_2$ corresponding to data ($G_1[7:4]$, $G_2[7:4]+1$), the basic correction value $D_3$ corresponding to data ($G_1[7:4]+1$, $G_2[7:4]$), and the basic correction value $D_4$ corresponding to data ($G_1[7:4]+1$, $G_2[7:4]+1$) to the corrected image data output part 30.

The basic correction value output part 20 includes a lookup table. That is, the lookup table stores each value of the data ($G_1[7:4]$, $G_2[7:4]$) and the basic correction value associated with each other and to the basic correction value output part 20, the data ($G_1[7:4]$, $G_2[7:4]$) is input for each pixel, and the basic correction value output part 20 also outputs the basic correction value $D_1$ corresponding thereto and also outputs the basic correction value $D_2$ corresponding to the data ($G_1[7:4]$, $G_2[7:4]+1$), the basic correction value $D_3$ corresponding to the data ($G_1[7:4]+1$, $G_2[7:4]$), and the basic correction value $D_4$ corresponding to the data ($G_1[7:4]+1$, $G_2[7:4]+1$).

To the corrected image data output part 30, the image data $G_1[7:0]$ of 8 bits of the first frame to be output from the delay part 10 is input and at the same time, the image data $G_2[7:0]$ of 8 bits of the second frame to be input to the delay part 10 is input and further, the basic correction values $D_1$ to $D_4$ output from the basic correction value output part 20 are also input. Then, the corrected image data output part 30 acquires the corrected image data $G_2'[7:0]$ corresponding to data ($G_1[7:0]$, $G_2[7:0]$) by interpolation calculation and outputs the corrected image data $G_2'[7:0]$ thus acquired to the liquid crystal display device 2.

Specifically, in the corrected image data output part 30, processing performed when "$G_1[7:4]=G_2[7:4]$" holds for the high order 4 bits of the image data is different from processing performed when "$G_1[7:4]\neq G_2[7:4]$" holds. Further, when the former "$G_1[7:4]=G_2[7:4]$" holds, in the corrected image data output part 30, processing performed when "$G_1[3:0]<G_2[3:0]$" for the low order 4 bits of the image data is different from processing performed when "$G_1[3:0]\geqq G_2[3:0]$" holds.

Figure 2:
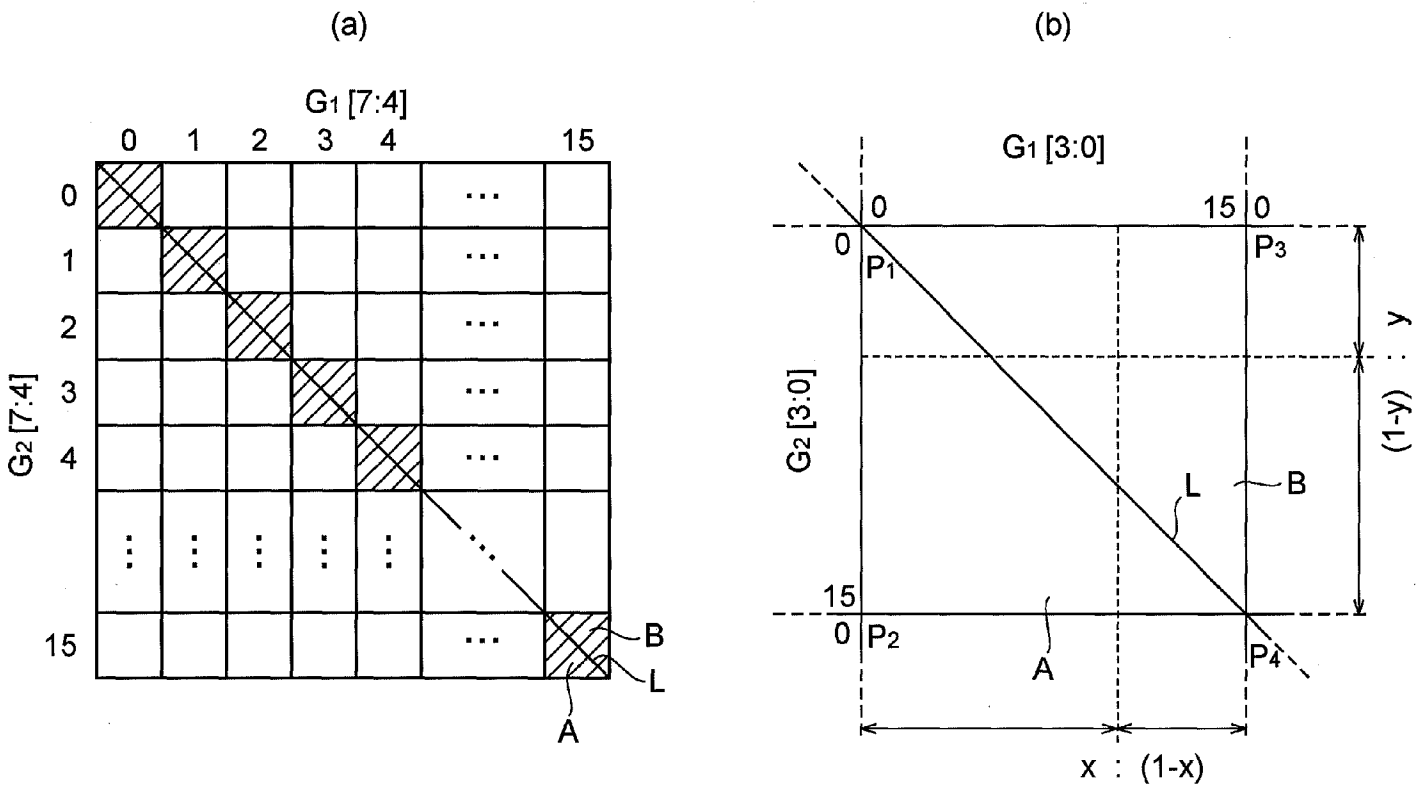
FIG. 2 is a diagram that represents image data $G_1[7:0]$ of a first frame and image data $G_2[7:0]$ of a second frame in a plane.

FIG. 2 is a diagram representing the image data $G_1[7:0]$ of the first frame and the image data $G_2[7:0]$ of the second frame in a plane. FIG. 2(*a*) is a diagram representing the data $G_1[7:4]$ of the high order 4 bits of the image data $G_1[7:0]$ and the data $G_2[7:4]$ of the high order 4 bits of the image data $G_2[7:0]$ in a plane, showing the region where "$G_1[7:4]=G_2[7:4]$" holds with slash lines. FIG. 2(*b*) is a diagram representing the data $G_1[3:0]$ of the low order 4 bits of the image data $G_1[7:0]$ and the data $G_2[3:0]$ of the low order 4 bits of the image data $G_2[7:0]$ when "$G_1[7:4]=G_2[7:4]$" holds (in the region shown with slash lines in FIG. 2(*a*)), and the region is divided into a region A where "$G_1[3:0]<G_2[3:0]$" holds and a region B where "$G_1[3:0]\geqq G_2[3:0]$" holds.

In FIGS. 2(*a*) and (*b*), on a straight line L, "$G_1[7:0]=G_2[7:0]$" holds. In FIG. 2(*b*), the basic correction value $D_1$ that the basic correction value output part 20 outputs in accordance with the data ($G_1[7:4]$, $G_2[7:4]$) equals the corrected image data $G_2'[7:0]$ for the data ($G_1[7:0]$, $G_2[7:0]$) indicated by a position $P_1$. The basic correction value $D_2$ that the basic correction value output part 20 outputs in accordance with the data ($G_1[7:4]$, $G_2[7:4]+1$) equals the corrected image data $G_2'[7:0]$ for data ($G_1[7:0]$, $G_2[7:0]+16$) indicated by a position $P_2$. The basic correction value $D_3$ that the basic correction value output part 20 outputs in accordance with the data ($G_1[7:4]+1$, $G_2[7:4]$) equals the corrected image data $G_2'[7:0]$ for data ($G_1[7:0]+16$, $G_2[7:0]$) indicated by a position $P_3$. The basic correction value $D_4$ that the basic correction value output part 20 outputs in accordance with the data ($G_1[7:4]+1$, $G_2[7:4]+1$) equals the corrected image data $G_2'[7:0]$ for data ($G_1[7:0]+16$, $G_2[7:0]+16$) indicated by a position $P_4$.

When both "$G_1[7:4]=G_2[7:4]$" and "$G_1[3:0]<G_2[3:0]$" hold (in the region A in FIG. 2(*b*)), the corrected image data output part 30 acquires the corrected image data $G_2'[7:0]$ by interpolation calculation based on the basic correction values $D_1$, $D_2$ and $D_4$, however, does not make use of the basic correction value $D_3$ output from the basic correction value output part 20 at this time. When both "$G_1[7:4]=G_2[7:4]$" and "$G_1[3:0]\geqq G_2[3:0]$" hold (in the region B in FIG. 2(*b*)), the corrected image data output part 30 acquires the corrected image data $G_2'[7:0]$ by interpolation calculation based on the basic correction values $D_1$, $D_3$ and $D_4$, however, does not make use of the basic correction value $D_2$ output from the basic correction value output part 20 at this time. That is, in both the cases described above, the corrected image data output part 30 acquires the corrected image data $G_2'[7:0]$ by interpolation calculation based on the three basic correction values. Further, when "$G_1[7:4]\neq G_2[7:4]$" holds (in the region other than the region with slash lines in FIG. 2(*a*)), the corrected image data output part 30 acquires the corrected image data $G_2'[7:0]$ by bilinear interpolation calculation based on the basic correction values $D_1$ to $D_4$.

Figure 3:
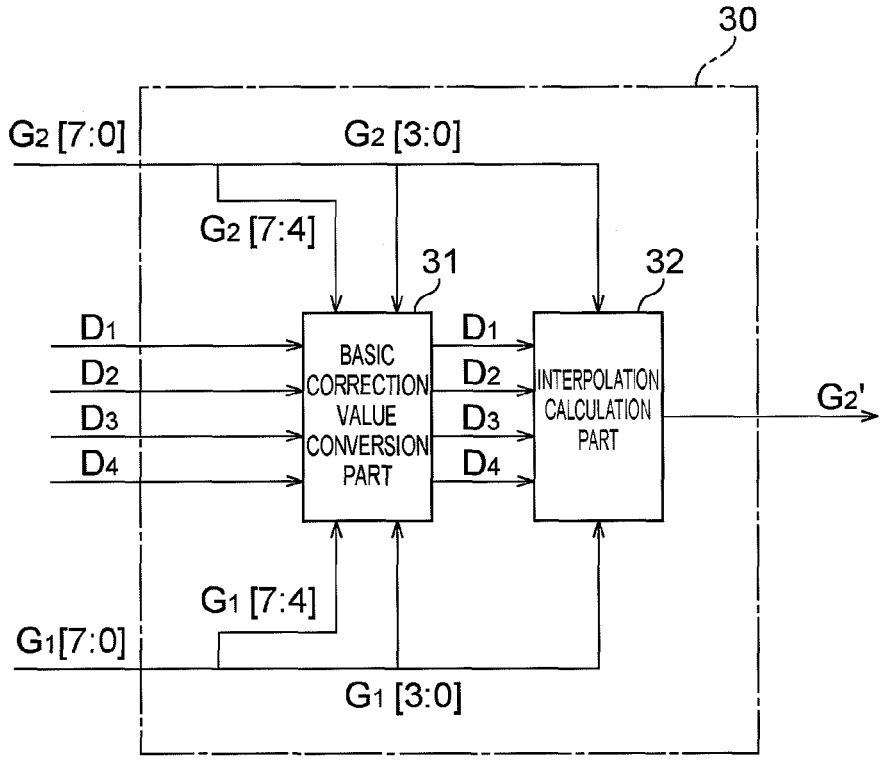
FIG. 3 is a diagram showing a configuration of a corrected image data output part 30 included in the image signal processing device 1 according to the present embodiment.

FIG. 3 is a diagram showing a configuration of the corrected image data output part 30 included in the image signal processing device 1 according to the present embodiment. The corrected image data output part 30 includes a basic correction value conversion part 31 and an interpolation calculation part 32.

The basic correction value conversion part 31 determines whether or not "$G_1[7:4]=G_2[7:4]$" holds and at the same time, determining whether or not "$G_1[3:0]<G_2[3:0]$" holds. Then, when both "$G_1[7:4]=G_2[7:4]$" and "$G_1[3:0]<G_2[3:0]$" hold (in the region A in FIG. 2(*b*)), the basic correction value conversion part 31 takes a value that can be obtained by the expression "$D_3=D_1+D_4-D_2$" as the basic correction value $D_3$. When both "$G_1[7:4]=G_2[7:4]$" and "$G_1[3:0]\geqq G_2[3:0]$" hold (in the region B in FIG. 2(*b*)), the basic correction value conversion part 31 takes a value that can be obtained by the expression "$D_2=D_1+D_4-D_3$" as the basic correction value $D_2$. When "$G_1[7:4]\neq G_2[7:4]$" holds (in the region other than the region with slash lines in FIG. 2(*a*)), the basic correction value conversion part 31 does not change the basic correction values $D_1$ to $D_4$.

The interpolation calculation part 32 acquires the corrected image data $G_2'[7:0]$ by bilinear interpolation calculation expressed by the following mathematical expression (1) based on the basic correction values $D_1$ to $D_4$. Then, the interpolation calculation part 32 outputs the corrected image data $G_2'[7:0]$ thus acquired to the liquid crystal display device 2.

$$G_2'=(1-x)\{(1-y)D_1+yD_2\}+x\{(1-y)D_3+yD_4\} \quad (1a)$$

$$x=G_1[3:0]/2^4 \quad (1b)$$

$$y=G_2[3:0]/2^4 \quad (1c)$$

In the image signal processing device 1 according to the present embodiment, the data $G_1[7:4]$ of the high order 4 bits of the image data $G_1[7:0]$ of the first frame to be output from the delay part 10 and the data $G_2[7:4]$ of the high order 4 bits of the image data $G_2[7:0]$ of the second frame (frame that follows the first frame) to be input to the delay part 10 are input to the basic correction value output part 20. Then, from the basic correction value output part 20, the basic correction value $D_1$ corresponding to the data ($G_1[7:4]$, $G_2[7:4]$), the basic correction value $D_2$ corresponding to the data ($G_1[7:4]$, $G_2[7:4]+1$), the basic correction value $D_3$ corresponding to the data ($G_1[7:4]+1$, $G_2[7:4]$), and the basic correction value $D_4$ corresponding to the data ($G_1[7:4]+1$, $G_2[7:4]+1$) are output to the corrected image data output part 30.

To the corrected image data output part 30, the image data $G_1[7:0]$ of the first frame and the image data $G_2[7:0]$ of the next second frame, and the basic correction values $D_1$ to $D_4$ output from the basic correction value output part 20 are input, and the corrected image data $G_2'[7:0]$ corresponding to the data ($G_1[7:0]$, $G_2[7:0]$) is acquired by interpolation calculation and the corrected image data $G_2'[7:0]$ thus acquired is output to the liquid crystal display device 2.

In particular, in the corrected image data output part 30, processing performed when "$G_1[7:4]=G_2[7:4]$" holds for the high order 4 bits of the image data is different from processing performed when "$G_1[7:4]\neq G_2[7:4]$" holds. Further, when the former "$G_1[7:4]=G_2[7:4]$" holds, in the corrected image data output part 30, processing performed when "$G_1[4:0]<G_2[4:0]$" holds for the low order 4 bits of the image data is different from processing performed when "$G_1[4:0]\geqq G_2[4:0]$" holds. That is, in the corrected image data output part 30, when both "$G_1[7:4]=G_2[7:4]$" and "$G_1[3:0]<G_2[3:0]$" hold, the corrected image data $G_2'[7:0]$ is acquired by interpolation calculation based on the basic correction values $D_1$, $D_2$ and $D_4$, and when both "$G_1[7:4]=G_2[7:4]$" and "$G_1[3:0]\geqq G_2[3:0]$" hold, the corrected image data $G_2'[7:0]$ is acquired by interpolation calculation based on the basic correction values $D_1$, $D_3$ and $D_4$, and when "$G_1[7:4]\neq G_2[7:4]$" holds, the corrected image data $G_2'[7:0]$ is acquired by bilinear interpolation calculation based on the basic correction values $D_1$ to $D_4$.

Figure 4:
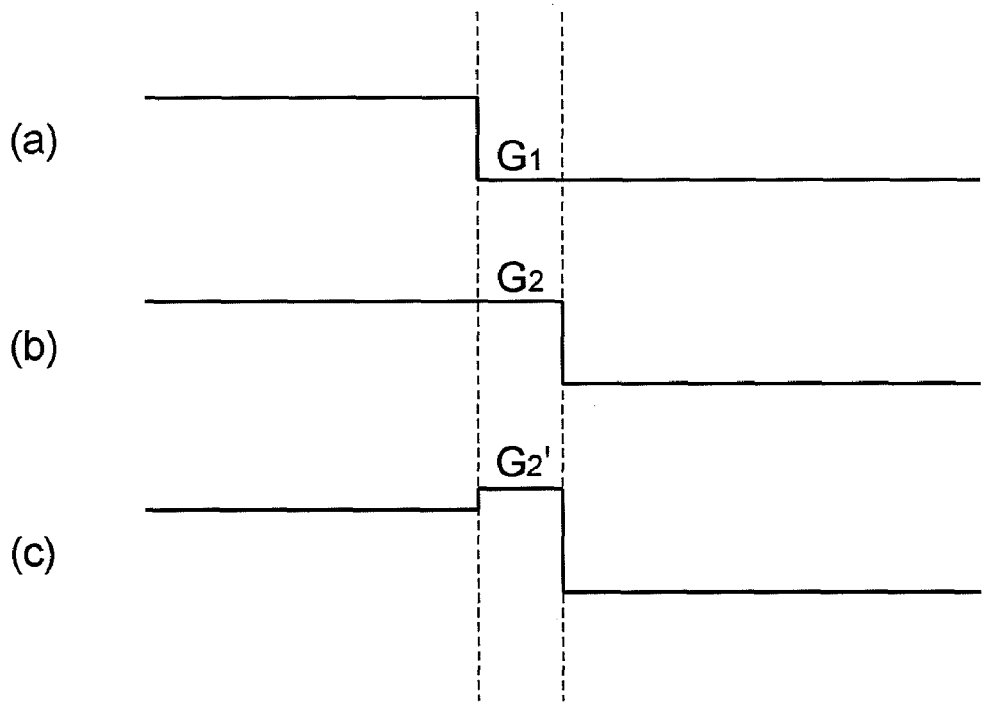
FIG. 4 is a diagram for describing the image data $G_1[7:0]$ of the first frame and the image data $G_2[7:0]$ of the second frame to be input to the image signal processing device 1 according to the present embodiment, and corrected image data $G_2'[7:0]$ output from the image signal processing device 1 to a liquid crystal display device 2.
Figure 5:
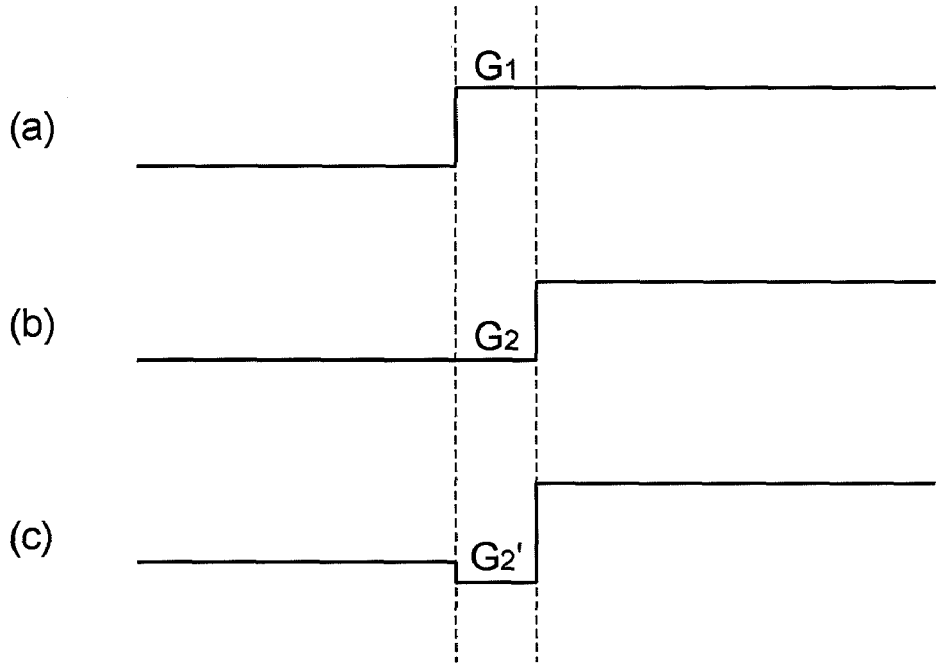
FIG. 5 is a diagram for describing the image data $G_1[7:0]$ of the first frame and the image data $G_2[7:0]$ of the second frame to be input to the image signal processing device 1 according to the present embodiment, and the corrected image data $G_2'[7:0]$ output from the image signal processing device 1 to the liquid crystal display device 2.

Further, when the corrected image data output part 30 has the configuration in FIG. 3, in the basic correction conversion part 31, when both "$G_1[7:4]=G_2[7:4]$" and "$G_1[3:0]<G_2[3:0]$" hold, a value obtained by the expression "$D_3=D_1+D_4-D_2$" is taken as the basic correction value $D_3$ and when both "$G_1[7:4]=G_2[7:4]$" and "$G_1[3:0]\geqq G_2[3:0]$" hold, a value obtained by the expression "$D_2=D_1+D_4-D_3$" is taken as the basic correction value $D_2$. Then, in the interpolation calculation part 32, the corrected image data $G_2'[7:0]$ is acquired by bilinear interpolation calculation based on the basic correction values $D_1$ to $D_4$ in all of the cases FIG. 4 and FIG. 5 are each a diagram for describing the image data $G_1[7:0]$ of the first frame and the $G_2[7:0]$ of the second frame to be input to the image signal processing device 1 according to the present embodiment, and the corrected image data $G_2'[7:0]$ output from the image signal processing device 1 to the liquid crystal display device 2. The transverse axis in each of FIG. (a) to (c) represents the pixel position on a certain line in an image of a frame. FIG. (a) shows a distribution of the image data $G_1[7:0]$ on the line of the first frame, FIG. (b) shows a distribution of the image data $G_2[7:0]$ on the line of the second frame, and FIG. (c) shows a distribution of the corrected image data $G_2'[7:0]$ on the line. The pixel in the center in each of FIG. (a) to (c) is focused on.

In the example shown in FIG. 4, the image data $G_2$ of the focused pixel in the next second frame is greater compared to the image data (luminance) $G_1$ of the focused pixel in the first frame (FIGS. (a), (b)), and therefore, the corrected image data $G_2'$ of the focused pixel to be output is supposed to be larger than the image data $G_2$ (FIG. (c)).

In the example shown in FIG. 5, the image data $G_2$ of the focused pixel in the next second frame is smaller compared to the image data $G_1$ of the focused pixel in the first frame (FIGS. (a), (b)), and therefore, the corrected image data $G_2'$ of the focused pixel to be output is supposed to be smaller than the image data $G_2$ (FIG. (c)). As described above, because the image data $G_2'$ after being corrected based on the overdrive technique is input to the liquid crystal display device 2, it is made possible for the actual display value in the liquid crystal display device 2 to reach a target display value quickly.

Figure 6:
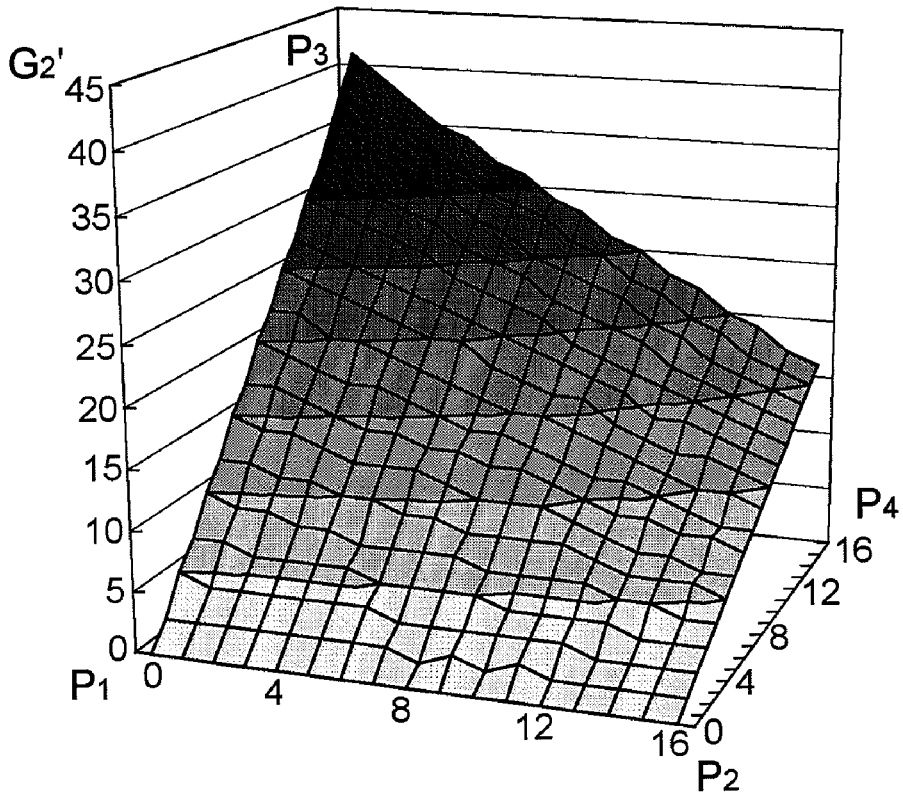
FIG. 6 is a diagram showing a distribution of the corrected image data $G_2'[7:0]$ output from an image signal processing device in a comparative example.
Figure 7:
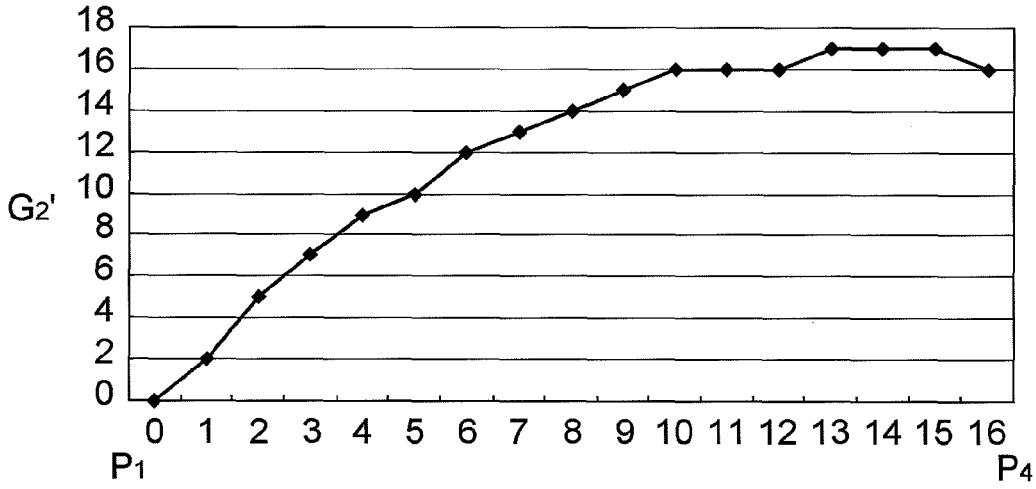
FIG. 7 is a diagram showing a distribution of the corrected image data $G_2'[7:0]$ output from an image signal processing device in a comparative example.
Figure 8:
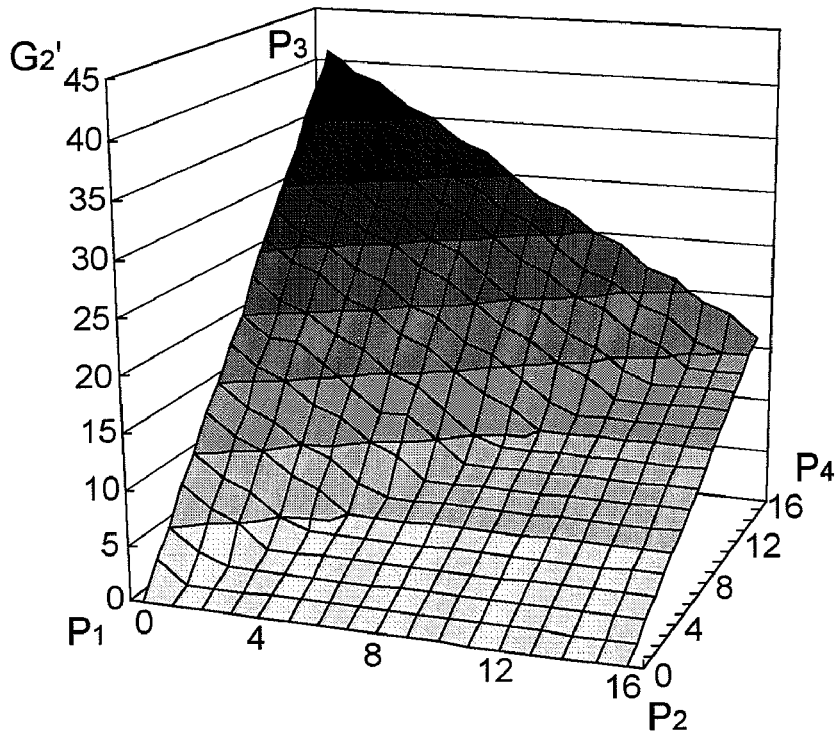
FIG. 8 is a diagram showing a distribution of the corrected image data $G_2'[7:0]$ output from the image signal processing device 1 according to the present embodiment.
Figure 9:
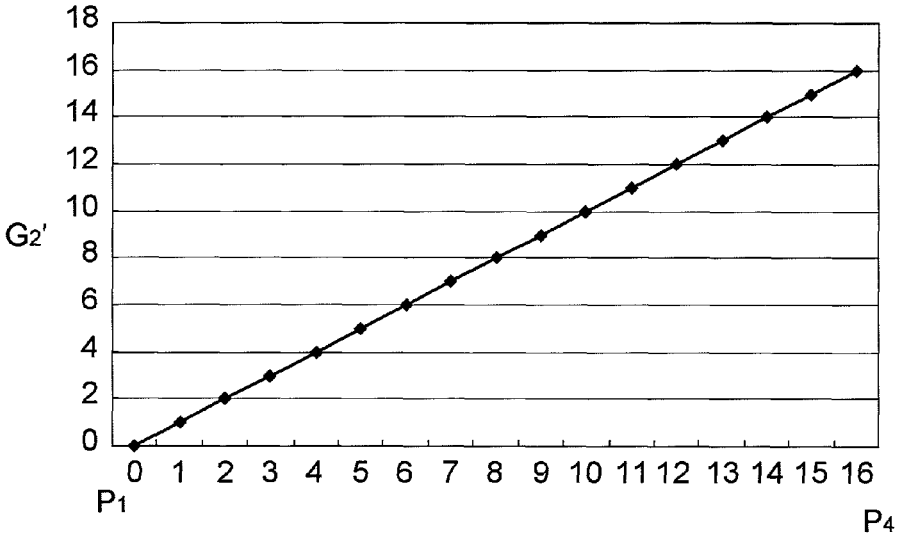
FIG. 9 is a diagram showing a distribution of the corrected image data $G_2'[7:0]$ output from the image signal processing device 1 according to the present embodiment.

FIG. 6 to FIG. 9 are each a diagram showing a distribution of the corrected image data $G_2'[7:0]$ output from the image signal processing device. FIG. 6 and FIG. 7 each show a distribution of the corrected image data $G_2'[7:0]$ output from an image signal processing device in a comparative example. The image signal processing device in the comparative example performs the bilinear interpolation calculation by the interpolation calculation part 32 without performing the processing by the basic correction value conversion part 31 in the image signal processing device 1 according to the present embodiment. FIG. 8 and FIG. 9 each show a distribution of the corrected image data $G_2'[7:0]$ output from the image signal processing device 1 according to the present embodiment. In each of FIG. 6 to FIG. 9, the basic correction value $D_1$ corresponding to the position $P_1$ in FIG. 2(*b*) is set to 0, the basic correction value $D_2$ corresponding to the position $P_2$ is set to 0, the basic correction value $D_3$ corresponding to the position $P_3$ is set to 41, and the basic correction value $D_4$ corresponding to the position $P_4$ is set to 10.

FIG. 6 shows a distribution of the corrected image data $G_2'$ in the range shown in FIG. 2(*b*) in the case of the comparative example and FIG. 7 shows a distribution of the corrected image data $G_2'$ on the straight line L in FIG. 2(*b*) in the case of the comparative example. In the comparative example, as shown in these figures, the distribution of the corrected image data $G_2'$ along the straight line L that satisfies "$G_1[7:0]=G_2[7:0]$" has a shape in which the part near the center is convex upward.

On the straight line L and in the region in the vicinity thereof, the difference between the pixel data $G_1$ of the first frame and the pixel data $G_2$ of the second frame is zero or very small, and therefore, no blur occurs (or the blur is small, if any, that will not bring about any problem) in a motion picture displayed on the screen of the liquid crystal display device 2 even when the overdrive technique is not applied. However, when only the overdrive technique that simply uses the lookup table and interpolation calculation as in the comparative example is applied, there may be a case where the corrected image data $G_2'$ given to the liquid crystal display device 2 becomes larger compared to the original image data $G_2$ on the straight line L and in the region in the vicinity thereof, and as a result of that, there may be a case where the image quality of an image displayed on the screen of the liquid crystal display device 2 is deteriorated due to a flicker etc.

In contrast to this, FIG. 8 shows the distribution of the corrected image data $G_2'$ in the range shown in FIG. 2(*b*) in the case of the present embodiment and FIG. 9 shows the distribution of the corrected image data $G_2'$ on the straight line L in the FIG. 2(*b*) in the case of the present embodiment. In the present embodiment, as shown in these figures, the distribution of the corrected image data $G_2'$ along the straight line L that satisfies "$G_1[7:0]=G_2[7:0]$" is excellent in linearity.

In the present embodiment, not only by applying the overdrive technique that uses the lookup table and interpolation calculation but also by figuring out a predetermined device at the time of the interpolation calculation based on the output value of the lookup table when "$G_1[7:4]=G_2[7:4]$" holds (in the case of the region with slash lines in FIG. 2(*a*)), the corrected image data $G_2'$ given to the liquid crystal display device 2 on the straight line L and in the region in the vicinity thereof is made equal to the original image data $G_2$ (or the difference becomes smaller) and as a result of that, the deterioration in image quality due to a flicker etc., is suppressed in an image displayed on the screen of the liquid crystal display device 2. The image processing described above is performed for each pixel.

The invention claimed is:

1. An image signal processing device that outputs an image signal to a liquid crystal display device after processing image data of each frame of the image signal, comprising:

a delay part to which image data of each frame of the image signal is input, and which outputs the image data after delaying the image data by a period of time corresponding to one frame;

a basic correction value output part:

to which:

data $G_1[n-1:k]$ of high order (n−k) bits of image data $G_1[n-1:0]$ of n bits of a first frame to be output from the delay part, where n is an integer equal to or greater than four and k an integer equal to or greater than two and equal to or less than (n−2); and data $G_2[n-1:k]$ of high order (n−k) bits of image data $G_2[n-1:0]$ of n bits of a second frame to be input to the delay part are input; and which outputs:

a basic correction value $D_1$ corresponding to data $(G_1[n-1:k], G_2[n-1:k])$;

a basic correction value $D_2$ corresponding to data $(G_1[n-1:k], G_2[n-1:k]+1)$;

a basic correction value $D_3$ corresponding to data $(G_1[n-1:k]+1, G_2[n-1:k])$; and a basic correction value $D_4$ corresponding to data $(G_1[n-1:k]+1, G_2[n-1:k]+1)$; and a corrected image data output part:

to which:

the image data $G_1[n-1:0]$ of n bits of the first frame to be output from the delay part;

the image data $G_2[n-1:0]$ of n bits of the second frame to be input to the delay part; and basic correction values $D_1$ to $D_4$ output from the basic correction value output part are input; and which acquires corrected image data corresponding to data $(G_1[n:0], G_2[n:0])$ by interpolation calculation and outputs the corrected image data thus acquired to the liquid crystal display device, wherein the corrected image data output part acquires, when "$G_1[n-1:k]=G_2[n-1:k]$" holds for the high order (n−k) bits of the image data:

the corrected image data by interpolation calculation based on the basic correction values $D_1$, $D_2$ and $D_4$ when "$G_1[k-1:0]<G_2[k-1:0]$" holds for the low order k bits of the image data;

the corrected image data by interpolation calculation based on the basic correction values $D_1$, $D_3$ and $D_4$ when "$G_1[k-1:0]\geqq G_2[k-1:0]$" holds for the low order k bits of the image data; and the corrected image data by bilinear interpolation calculation based on the basic correction values $D_1$ to $D_4$ when "$G_1[n-1:k]\neq G_2[n-1:k]$" holds for the high order (n−k) bits of the image data.

2. The image signal processing device according to claim 1, wherein the corrected image data output part acquires, when "$G_1[n-1:k]=G_2[n-1:k]$" holds, the corrected image data by bilinear interpolation calculation based on the basic correction value $D_1$ to $D_4$ by:

taking a value obtained by an expression "$D_3=D_1+D_4-D_2$" as the basic correction value $D_3$ when "$G_1[k-1:0]<G_2[k-1:0]$" holds for the low order k bits of the image data; and taking a value obtained by an expression "$D_2=D_1+D_4-D_3$" as the basic correction value $D_2$ when "$G_1[k-1:0]\geqq G_2[k-1:0]$" holds for the low order k bits of the image data.

* * * * *